US012234003B1

(12) United States Patent
Kraus et al.

(10) Patent No.: US 12,234,003 B1
(45) Date of Patent: Feb. 25, 2025

(54) DEVICES AND METHODS FOR MAKING DEVICES FOR SUPPORTING A PROPULSOR ON A MARINE VESSEL

(71) Applicant: Brunswick Corporation, Mettawa, IL (US)

(72) Inventors: Jeremy J. Kraus, Mt. Calvary, WI (US); Andres Perdomo Tornbaum, Neenah, WI (US); Tom Geng, Wuxi (CN); Steven Lu, Suzhou (CN); Matthew Z. Seta, Fond du Lac, WI (US); Keith W. Schmidt, Stillwater, OK (US); James E. Erickson, Fond du Lac, WI (US); Ronald L. Hall, Stillwater, OK (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 18/244,096

(22) Filed: Sep. 8, 2023

Related U.S. Application Data

(63) Continuation of application No. 17/376,869, filed on Jul. 15, 2021, now Pat. No. 11,801,926, which is a (Continued)

(51) Int. Cl.
*B63H 5/125* (2006.01)
*B63H 20/02* (2006.01)

(52) U.S. Cl.
CPC ..... *B63H 5/125* (2013.01); *B63H 20/02* (2013.01); *B63H 2005/1256* (2013.01)

(58) Field of Classification Search
CPC . B63H 5/125; B63H 20/02; B63H 2005/1256
See application file for complete search history.

(56) References Cited

U.S. PATENT DOCUMENTS 2,213,520 A 9/1940 Gentry
3,236,202 A 2/1966 Quady et al.
(Continued)

FOREIGN PATENT DOCUMENTS

EP 1611007 8/2007
EP 1914161 4/2008
(Continued)

OTHER PUBLICATIONS

Tornbaum, Andres Perdomo, "Methods for a Marine Vessel with Primary and Auxiliary Propulsion Devices," Unpublished U.S. Appl. No. 16/984,617, filed Aug. 4, 2020 (specification and drawings only).

(Continued)

*Primary Examiner* — Andrew Polay
(74) *Attorney, Agent, or Firm* — Andrus Intellectual Property Law, LLP

(57) ABSTRACT

A device for supporting a propulsor on a marine vessel. The device includes a base that is fixable to the marine vessel and a pivot arm for coupling the propulsor to the base. An actuator is configured to pivot the pivot arm relative to the base into and between a retracted position and a deployed position. A fastener is engageable to couple the actuator to the pivot arm, where when the fastener is engaged the pivot arm is prevented from pivoting other than by the actuator, and where applying a predetermined force on the pivot arm disengages the fastener to allow the pivot arm to pivot other than by the actuator.

19 Claims, 9 Drawing Sheets

Related U.S. Application Data continuation-in-part of application No. 17/185,289, filed on Feb. 25, 2021, now Pat. No. 11,572,146.

(56) References Cited

U.S. PATENT DOCUMENTS

| | | | | |
|---|---|---|---|---|
| 3,462,102 | A | 8/1969 | Rivers | |
| 3,809,343 | A | 5/1974 | Adams et al. | |
| 3,865,335 | A | 2/1975 | Roller et al. | |
| 3,874,318 | A | 4/1975 | Langley | |
| 3,995,579 | A | 12/1976 | Childre | |
| 3,999,500 | A | 12/1976 | Friedel et al. | |
| 4,008,680 | A | 2/1977 | Alexander, Jr. | |
| 4,294,186 | A | 10/1981 | Wardell | |
| 4,410,161 | A | 10/1983 | Booty | |
| 4,548,586 | A | 10/1985 | Philips | |
| 4,734,068 | A | 3/1988 | Edwards | |
| 4,875,656 | A | 10/1989 | Boede | |
| 4,911,398 | A | 3/1990 | Diiulio et al. | |
| 4,966,566 | A | 10/1990 | Baird | |
| 5,005,798 | A | 4/1991 | McCoy | |
| 5,022,609 | A | 6/1991 | Cranston | |
| 5,131,875 | A | 7/1992 | Lee | |
| 5,152,240 | A | 10/1992 | Fontanille | |
| 5,195,914 | A | 3/1993 | Binversie et al. | |
| 5,277,630 | A | 1/1994 | Clark | |
| 5,499,792 | A | 3/1996 | Tamiso | |
| 5,595,133 | A | 1/1997 | Bullard | |
| 5,639,272 | A | 6/1997 | Henderson et al. | |
| 5,669,794 | A | 9/1997 | Knight et al. | |
| 5,934,955 | A * | 8/1999 | Heston | B63H 20/10 440/61 R |
| 5,941,742 | A | 8/1999 | Whitaker | |
| 6,142,841 | A | 11/2000 | Alexander, Jr. et al. | |
| 6,257,165 | B1 | 7/2001 | Danos et al. | |
| 6,280,267 | B1 | 8/2001 | Griffith, Sr. et al. | |
| 6,325,685 | B1 | 12/2001 | Knight et al. | |
| 6,431,923 | B1 | 8/2002 | Knight et al. | |
| 6,592,412 | B1 | 7/2003 | Geil et al. | |
| 6,789,648 | B2 | 9/2004 | Cook | |
| 7,004,803 | B2 | 2/2006 | Ruffe | |
| 7,004,804 | B2 | 2/2006 | Bernloehr et al. | |
| RE39,032 | E | 3/2006 | Gonring et al. | |
| 7,150,662 | B1 | 12/2006 | Janitz | |
| 7,182,033 | B1 | 2/2007 | Philips et al. | |
| 7,185,599 | B1 | 3/2007 | Griffiths et al. | |
| 7,285,029 | B1 | 10/2007 | Janitz | |
| 7,294,029 | B1 | 11/2007 | Spaulding | |
| 7,305,928 | B2 | 12/2007 | Bradley et al. | |
| 7,399,211 | B1 | 7/2008 | Spaulding | |
| 7,510,450 | B1 | 3/2009 | Dresher | |
| 7,520,239 | B2 | 4/2009 | Bryham | |
| 7,533,622 | B1 | 5/2009 | Jaszewski et al. | |
| 7,753,745 | B2 | 7/2010 | Schey et al. | |
| 7,806,065 | B1 | 10/2010 | Bekker et al. | |
| 7,887,381 | B2 | 2/2011 | Brass et al. | |
| 7,946,243 | B1 | 5/2011 | Ulrich | |
| 8,011,982 | B1 | 9/2011 | Baier et al. | |
| 8,051,793 | B2 | 11/2011 | Ulgen | |
| 8,123,577 | B2 | 2/2012 | Riggs | |
| 8,479,677 | B2 | 7/2013 | Bolline et al. | |
| 8,814,616 | B2 | 8/2014 | Riggs | |
| 9,108,710 | B1 | 8/2015 | Mcchesney et al. | |
| 9,296,455 | B2 | 3/2016 | Bernloehr et al. | |
| 9,586,655 | B1 | 3/2017 | Butler | |
| 9,738,364 | B2 | 8/2017 | Abney | |
| 9,889,914 | B1 | 2/2018 | Ostrowsky | |
| 9,896,162 | B2 | 2/2018 | Mcclure | |
| 9,969,474 | B1 | 5/2018 | Traux et al. | |
| 10,167,069 | B2 | 1/2019 | Houle et al. | |
| 10,220,926 | B1 | 3/2019 | Pelini | |
| 10,407,131 | B1 | 9/2019 | Ward | |
| 10,850,820 | B1 | 12/2020 | Minogue | |
| 11,591,057 | B2 | 2/2023 | Tornbaum et al. | |
| 11,603,179 | B2 | 3/2023 | Poirier et al. | |
| 11,643,176 | B1 | 5/2023 | Mueller et al. | |
| 2002/0142680 | A1 | 10/2002 | Anderson | |
| 2006/0228959 | A1 | 10/2006 | Ruiz | |
| 2007/0232159 | A1 | 10/2007 | Lee | |
| 2008/0190227 | A1 | 8/2008 | Myers et al. | |
| 2009/0227158 | A1 | 9/2009 | Bernloehr et al. | |
| 2010/0032545 | A1 | 2/2010 | Bernloehr et al. | |
| 2010/0116967 | A1 * | 5/2010 | Todd | B63H 20/007 248/642 |
| 2010/0136857 | A1 | 6/2010 | Goudsmit | |
| 2012/0097086 | A1 | 4/2012 | Sancoff | |
| 2014/0158037 | A1 | 6/2014 | George | |
| 2015/0201548 | A1 | 7/2015 | Wolter et al. | |
| 2015/0259033 | A1 | 9/2015 | George et al. | |
| 2016/0001865 | A1 | 1/2016 | Bernloehr et al. | |
| 2017/0203823 | A1 | 7/2017 | Abney | |
| 2017/0341718 | A1 | 11/2017 | Zimmerman | |
| 2018/0057130 | A1 * | 3/2018 | Houle | B63H 5/20 |
| 2018/0334233 | A1 | 11/2018 | Vance | |
| 2019/0217921 | A1 | 7/2019 | Shibayama et al. | |
| 2021/0354803 | A1 | 11/2021 | Christensen et al. | |
| 2021/0380210 | A1 | 12/2021 | Fishburn et al. | |
| 2022/0266968 | A1 | 8/2022 | Tornbaum et al. | |

FOREIGN PATENT DOCUMENTS

| | | |
|---|---|---|
| EP | 2757037 | 7/2014 |
| EP | 2242678 | 11/2015 |
| EP | 2246252 | 5/2019 |
| GB | 2554045 | 3/2018 |
| JP | 2013100013 | 5/2013 |

OTHER PUBLICATIONS

Owerboat Television, "How to make docking a pontoon boat easy with a retractable SideShift Thruster | My Boat DIY", YouTube video, Jun. 1, 2020, available at https://www.youtube.com/watch?v=2NBx-Vnl3Kk.

Sideshift Inc., "Sideshift Dock Like a Pro PT230/PT360 Pontoon Thruster System," Installation/Operation Manual, Oct. 2019, vol. 2.4.

International Search Report and Written Opinion for International Application No. PCT/CA/2016/050308 mailed Jun. 9, 2016.

Unpublished U.S. Appl. No. 17/377,061, filed Jul. 15, 2021 by Andres Perdomo Tornbaum.

Unpublished U.S. Appl. No. 17/376,869, filed Jul. 15, 2021 by Jeremy J. Kraus.

Unpublished U.S. Appl. No. 17/378,383, filed Jul. 16, 2021 by Andres Perdomo Tornbaum.

Unpublished U.S. Appl. No. 17/379,435, filed Jul. 19, 2021 by Andres Perdomo Tornbaum.

Unpublished U.S. Appl. No. 17/388,850, filed Jul. 29, 2021 by Jeremy J. Kraus.

Unpublished U.S. Appl. No. 17/553,245, filed Dec. 16, 2021 by Jeremy J. Kraus.

Unpublished U.S. Appl. No. 29/823,128, filed Jan. 14, 2022 by Matthew Z. Seta.

Unpublished U.S. Appl. No. 18/091,062, filed Dec. 29, 2022 by Jeremy J. Kraus.

Unpublished U.S. Appl. No. 18/099,784, filed Jan. 20, 2023 by Jim Erickson.

* cited by examiner

DEVICES AND METHODS FOR MAKING DEVICES FOR SUPPORTING A PROPULSOR ON A MARINE VESSEL

CROSS REFERENCE TO RELATED APPLICATION

This application is a continuation of U.S. patent application Ser. No. 17/376,869, filed Jul. 15, 2021, which is a continuation in part of U.S. patent application Ser. No. 17/185,289, filed Feb. 25, 2021, which are incorporated herein by reference in their entireties.

FIELD

The present disclosure generally relates to stowable propulsors for marine vessels.

BACKGROUND

The following U.S. Patents provide background information and are hereby incorporated by reference in entirety.

U.S. Pat. No. 6,142,841 discloses a maneuvering control system which utilizes pressurized liquid at three or more positions of a marine vessel to selectively create thrust that moves the marine vessel into desired locations and according to chosen movements. A source of pressurized liquid, such as a pump or a jet pump propulsion device, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired.

U.S. Pat. No. 7,150,662 discloses a docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,305,928 discloses a vessel positioning system which maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,753,745 discloses status indicators for use with a watercraft propulsion device. An example indicator includes a light operatively coupled to a propulsion device of a watercraft, wherein an operation of the light indicates a status of a thruster system of the propulsion device.

U.S. Pat. No. RE39032 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

European Patent Application No. EP 1,914,161, European Patent Application No. EP2,757,037, and Japanese Patent Application No. JP2013100013A also provide background information and are hereby incorporated by reference in entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure generally relates to a device for supporting a propulsor on a marine vessel. The device includes a base that is fixable to the marine vessel and a pivot arm for coupling the propulsor to the base. An actuator is configured to pivot the pivot arm relative to the base into and between a retracted position and a deployed position. A fastener is engageable to couple the actuator to the pivot arm, where when the fastener is engaged the pivot arm is prevented from pivoting other than by the actuator, and where applying a predetermined force on the pivot arm disengages the fastener to allow the pivot arm to pivot other than by the actuator.

The present disclosure generally relates to a method for making a device for supporting a propulsor on a marine vessel. The method includes configuring a base for coupling to the marine vessel, and pivotally coupling the propulsor to the base via a pivot arm. The method further includes coupling an actuator to pivot the pivot arm relative to the base into and between a stowed position and a deployed position, and positioning a fastener to be engageable to couple the actuator to the pivot arm, where when the fastener is engaged the pivot arm is prevented from pivoting other than by the actuator, and where applying a predetermined force on the pivot arm disengages the fastener to allow the pivot arm to pivot other than by the actuator.

In some embodiments according to the present disclosure, a base is configured to be coupled to the marine vessel and defines an axle opening therein, an axle is configured to be received in the axle opening of the base. Two forks each extend between a neck and an opposing fork segment, where one of the two forks is an actuation fork, and where the opposing fork segments of the actuation fork are pivotally coupled to the base via the axle. The opposing fork segments of the actuator fork each have upper and lower edges with an opening is defined through each of the opposing fork segments that is open at the lower edges corresponding thereto. A shaft has a propulsor configured thereto, where the shaft is movable into and between a locked and a deployed position with a stowed position therebetween. The propulsor is configured to propel the marine vessel in water when the shaft is in the deployed position. An actuator is pivotally coupled to the base, where the actuator is a linear actuator, and where the engagement arm is sandwiched between the opposing fork segments and the actuator. Opposing engagement arms are pivotally coupled to the base via the axle, the opposing engagement arms also being pivotally coupled to the actuator. A fastener is engageable to couple the actuator to the actuation fork, where when the fastener is engaged the actuator prevents the shaft from being moved manually, and where applying a predetermined force on the shaft disengages the fastener to allow the shaft to be moved manually.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

The present disclosure generally relates to propulsion devices for marine vessels, and particularly those having propulsors movable between stowed and deployed positions. The present inventors have recognized problems with propulsion devices presently known in the art, including a risk of damage when the propulsor strikes an underwater object such as a log. These underwater impacts can cause damage to actuators (e.g., those that move the propulsor between the deployed and stowed positions) and other components within the propulsion device more generally. Additionally, the inventors have recognized that propulsors moveable between stowed and deployed positions as presently known in the art do not provide a fail-safe for when the actuator fails. In other words, propulsion devices presently known in the art do not offer operators a mechanism for manually moving the propulsor when the actuator is inoperable, for example due to damage or power loss.

Figure 1:
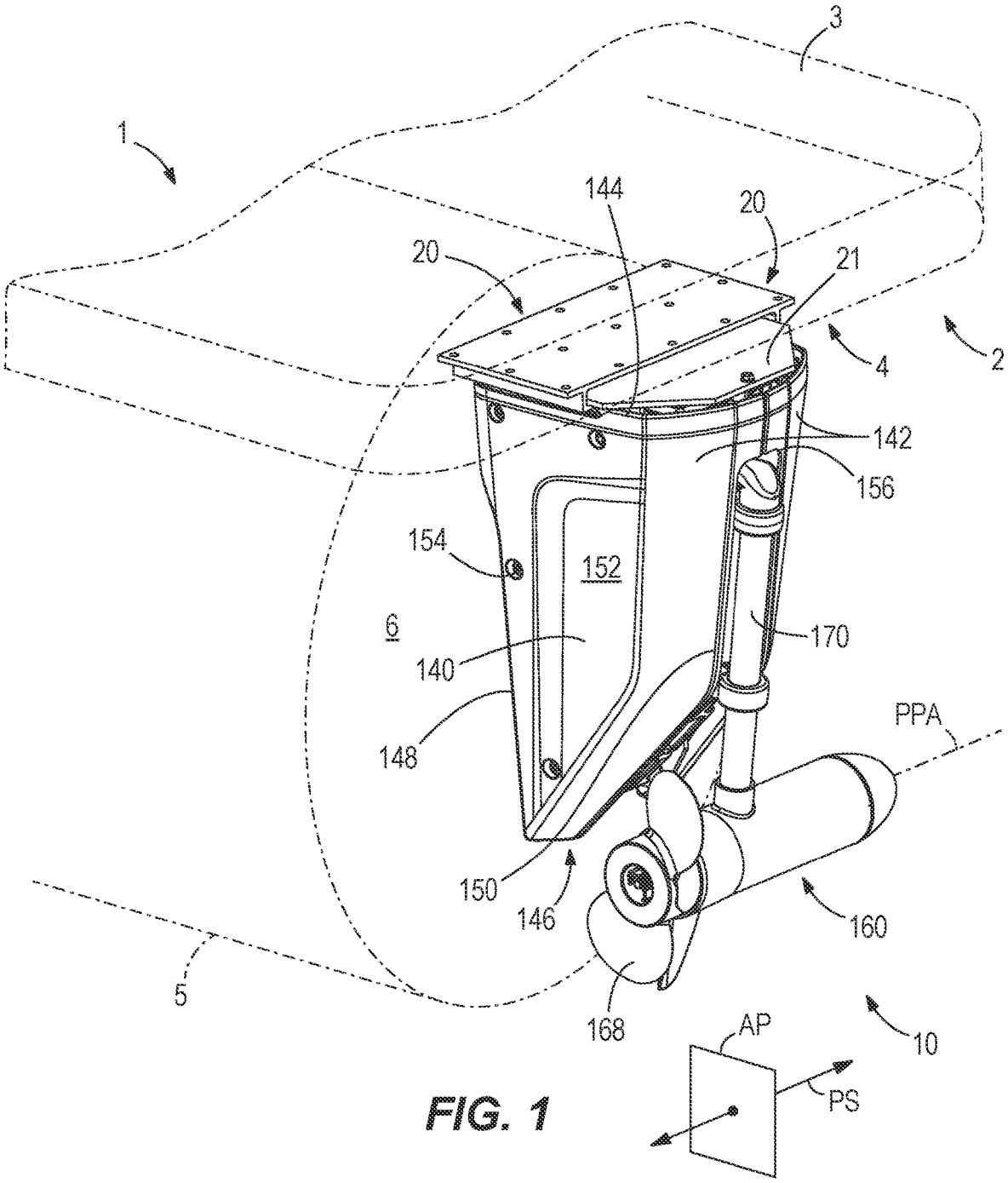
FIG. 1 is a rear perspective view of marine vessel incorporating a device according to the present disclosure with a pivot arm in a stowed position.

FIG. 1 depicts a propulsion device 10 according to the present disclosure, here shown coupled to a marine vessel 1. The marine vessel 1 extends between a bow and a stern 2, as well as between port and starboard sides. The marine vessel 1 has pontoons 5 attached to an underside 4 of a deck 3 in a customary manner. The propulsion device 10 has a base 20 that is coupled to the underside 4 of the deck 3 behind the back 6 of one of the pontoons 5. This positioning shields the propulsion device 10 from water turbulence when the marine vessel 1 is propelled forward other than by the propulsion device 10 (such as an outboard motor as presently known in the art).

As will be discussed further below, the propulsion device 10 includes a shaft 170 with a propulsor 160 coupled thereto. The shaft 170 and propulsor 160 are moveable between a stowed position as presently shown and a deployed position (see FIG. 4). The shaft 170 is moveable within a plane AP and the propulsor 160 is configured to propel the marine vessel 1 in the water in the port-starboard direction PS when in the deployed position. The propulsor 160 generates a thrust force for moving the marine vessel 1 via rotation of a propeller 168 about a propeller shaft axis PPA in a customary manner (e.g., rotated by an electric motor contained within the body of the propulsor 160 and powered by a battery or other power source). However, it should be recognized that other types of propulsors are also contemplated by the present disclosure, including jet drives or impellers, for example.

The propulsion device 10 of FIG. 1 further includes a cowling 140 formed by two side panels 142. The side panels 142 each extend between a top 144 and a bottom 146, a front 148 and a back 150, and an outside surface 150 opposite an inside surface (not numbered). Openings 154 are defined within the side panels 142 for anchoring the side panels 142 in the positions shown. By way of non-limiting example, a fastener such as a screw or bolt may be inserted through the openings 154 and threaded into a corresponding opening (not shown) in the base 20 of the propulsion device 10, which is partially obscured by the cowling 140. A shaft opening 156 is defined between the side panels 142 of the cowling 140 when assembled, allowing the shaft 170 to move between the stowed and deployed positions without interference by the cowling 140.

Figure 2:
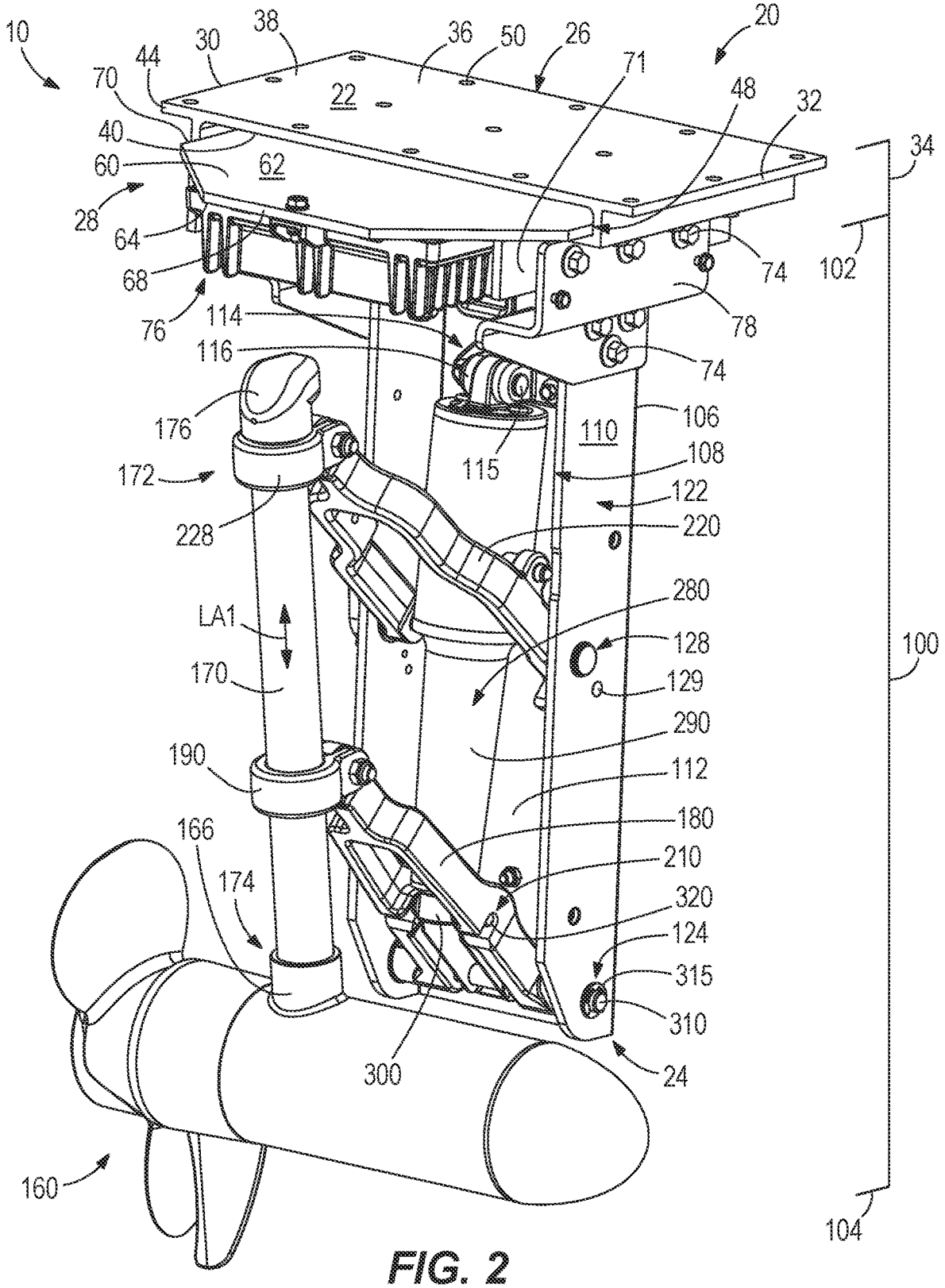
FIG. 2 is a rear perspective view of the device of FIG. 1 with a cowling removed.

FIG. 2. shows an opposing rear view of the propulsion device 10 of FIG. 1 with the cowling 140 removed. As previously discussed, the propulsion device 10 is coupled to the marine vessel 1 via a base 20. The base 20 extends between a top 22 and a bottom 24, a front 26 and a back 28, and a left 30 and a right 32. The base 20 generally divided into a first portion 34 and a second portion 100. The first portion 34 includes a mounting bracket 36 having a top 38 and a bottom 40, as well as a C-channel 48 extending downwardly from the top 38 that runs from the front 26 to the back 28 of the base 20. Openings 50 are provided through the mounting bracket 36 for coupling the first portion 34 to the marine vessel 1, for example via fasteners such as nuts and bolts or screws.

The mounting bracket 36 is configured to receive and support a carriage 60 therein. The carriage 60 extends between a top 62 and a bottom 64 with sides 70 therebetween configured to correspond with the C-channels 48 of the mounting bracket 36. The carriage 60 is received within the opposing C-channels 48 by inserting from the back 34 of the mounting bracket 36. A back 68 of the carriage 60 need not be received within the mounting bracket 36.

With continued reference to FIG. 2, side extensions 71 extend downwardly from the top 62 of the carriage 60. A bracket 78 couples the carriage 60 to the second portion 100 of the base 20. In particular, openings are defined through the bracket 78 through which fasteners 74 may extend to couple the bracket 78 to the carriage 60 (here via the side extensions 71) and to the second portion 100. In this manner, the second portion 100 is slidable with the carriage 60 within the mounting bracket 36.

The second portion 100 extends between a top 102 and a bottom 104, a front 106 and a back 108, and sides 110 therebetween. The second portion 100 has a front plate 112 with side extensions 122 that extend rearwardly therefrom. A shackle plate 114 having arms 116 is coupled to front plate 112 via methods presently known in the art, such as using fasteners, welds, and/or rivets. An axle opening 124, pin opening 128, and lock opening 129 are defined within the side extension 122, as discussed further below. The terms "axle." "pin," and "lock" with respect to the openings described above are used to distinguish between these features and are non-limiting on the components configured to be received therein.

Figure 3:
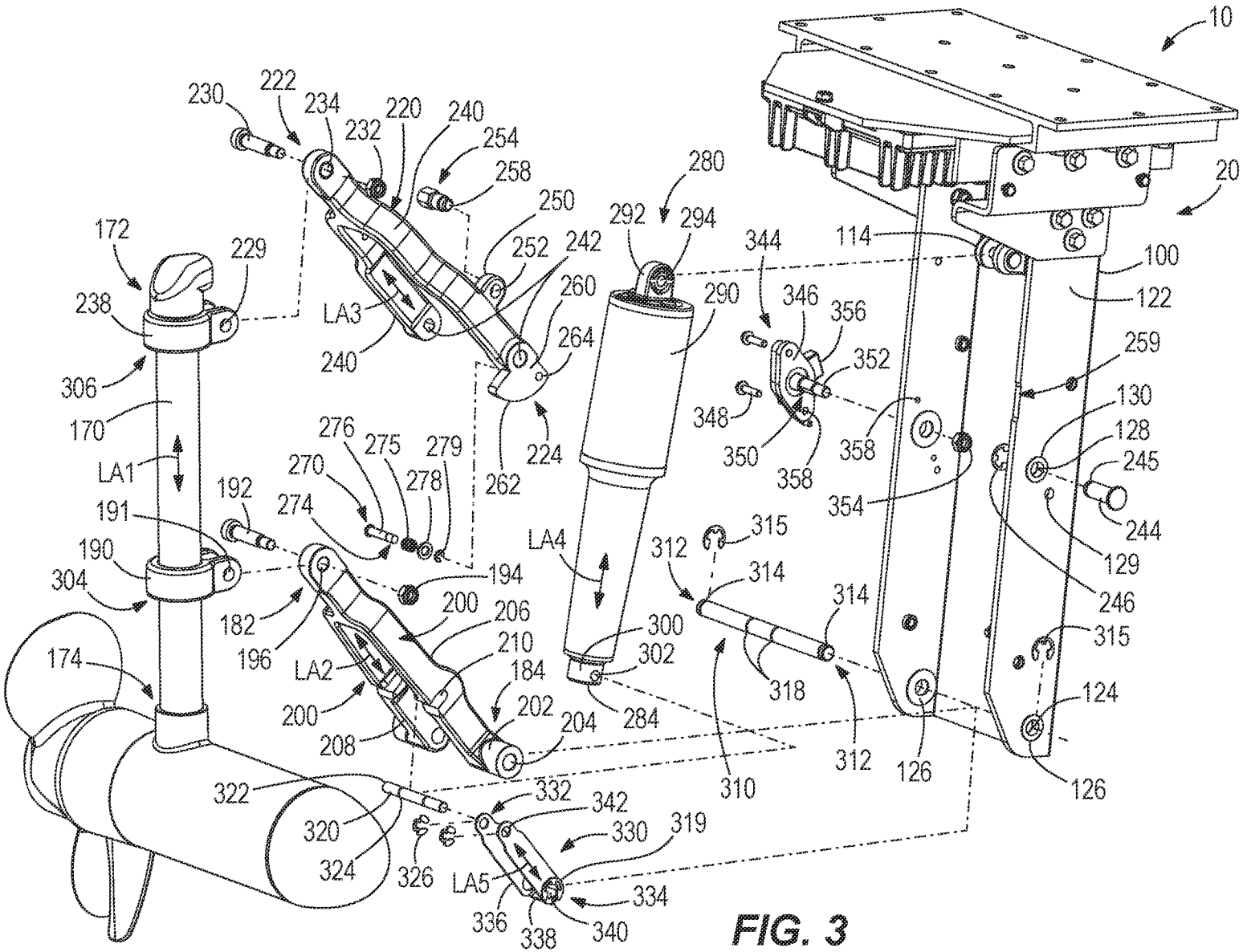
FIG. 3 is an exploded view of FIG. 2.

With reference to FIGS. 2 and 3, the propulsion device 10 includes a shaft 170 that extends between a first end 172 and second end 174 defining a length access LA1 therebetween. The propulsor 160 is coupled to the second end 174 of the shaft 170, particularly at an extension collar 166 extending from a body 164 of the propulsor 160. Power and communication are provided to propulsor 160 by a wire extending through the shaft 170. The wire (not expressly shown) exits the shaft 170 through a wire gasket 176 positioned at the first end 172, which prevents water and debris ingress into the shaft 170.

A pivot arm 180 extends between a neck at a first end 182 and a second end 184, defining a length axis LA2 therebetween. The pivot arm 180 is pivotally coupled to a first location 304 on the shaft 170 via a clamp 190 defining openings 191 therein. The first end 182 of the pivot arm 180 is coupled to the clamp 190 via a fastener that extends through the opening 191 in the clamp and an opening 196 at the first end 182, shown here as a bolt 192 and nut 194. It should be recognized that other types of fasteners are also anticipated by the present disclosure, including axles, pins, and/or the like.

With continued reference to FIGS. 2 and 3, the pivot arm 180 divides into opposing fork segments 200 as the pivot arm 180 extends from the first end 182 to the second end 184. The opposing fork segments 200 each have an upper edge 206 and a lower edge 208. An opening 210 is provided through the opposing fork segments 200, here open to the lower edges 208 thereof. Barrels 202 extend outwardly from each of the opposing fork segments 200 at the second end 184 of the pivot arm 180 with openings 204 provided at least partially into the barrels 202 (shown here to extend entirely therethrough).

The openings 204 are configured to receive an axle 310 therein or therethrough. The axle 310 shown extends linearly between opposing ends 312 (FIG. 3) with a pair of outer grooves 314 recessed into the axle 310 near to the opposing ends 312, and inner grooves 318 also recessed into the axle 310 closer to a midpoint thereof. The pivot arm 180 is pivotally coupled to the base 20 via the axle 310 extending through the axle opening 124 in the base 20 as well as through the openings 204 and the opposing fork segments 200. The axle 310 is axially retained within the base 20 via retaining rings 315 received within the outer grooves 314.

The propulsion device 10 or FIGS. 2 and 3 also includes a secondary arm 220 extending from a neck at a first end 222 to a second end 224 defining a length axis LA3 therebetween. An opening 234 is defined within the first end 222 of the secondary arm 220. The secondary arm 220 is coupled to a second location 306 of the shaft 170 via a clamp 228 in a similar manner to the clamp 190 discussed above. A bolt 230 is received through the opening 234 in the first end 222 and through and opening 229 in the clamp 228, which is threadedly engaged with a nut 232. However, it should be recognized that other types of fasteners may also be used to couple the secondary arm 220 to the shaft 170, including cotter pins, press-fit pins, rivets, and/or other commercially available hardware.

Similar to the pivot arm 180, the secondary arm 220 divides between the first end 222 to the second end 224 into opposing fork segments 240 each defining an opening 242 at the second end 224. However, it should be recognized that the present disclosure also contemplates pivot arms 180 and/or secondary arms 220 that do not divide at the corresponding second ends 184, 224 into opposing fork segments 200, 240, respectively. The secondary arm 220 is pivotally coupled to the base 20 via fasteners received through the pin opening 128 in the base 20 and through the openings 242 in the opposing fork segments 240, shown here as a pin 244 defining a groove 245 therein for receiving a retaining ring 246 similar to the axle 310. As discussed above, fasteners other than pins are also contemplated by the present disclosure, including nuts and bolts, rivets, and/or the like.

With continued reference to FIGS. 2 and 3, the propulsion device 10 further includes an actuator 280 that extends from a mounting tab at a first end 292 to a second end 284. The actuator 280 presently shown is a linear actuator having a housing 290 with a rod 300 that extends and retracts therefrom along a length axis LA4. An opening 294 is provided at the first end 292 the actuator 280 and is configured to receive a fastener 115 therethrough (FIG. 2) to pivotally couple the actuator 280 to the shackle plate 114 of the base 20. Similarly an opening 302 is provided within the rod 300 at the second end 284 of the actuator 280. In this manner, the distance between the first end 292 and second end 284 in the actuator 280 varies via actuation of the actuator 280, which is discussed below causes movement of the shaft 170 between the stowed and deployed position.

The shaft 170 attached to the propulsor 160 is removably coupled to the actuator 280 via a fastener engageable between the actuator 280 and the pivot arm 180. The fastener, shown here as shaft 320, extends between opposing ends 322 with grooves 324 recessed into the shaft 320. The shaft 320 extends through the opening 302 in the rod 300 of the actuator 280, shown here to extend perpendicularly from the length axis LA4 thereof. As shown in FIG. 2, the shaft 320 is received within the opening 210 in the opposing fork segments 200 of the pivot arm 180. In certain embodiments, the shaft 320 has a press-fit arrangement with the opening 210 such that moving the shaft 320 from the lower edge 208 to the upper edge 206 of the opposing fork segments 200 causes the shaft 320 to be seated within the opening 210.

Figure 6:
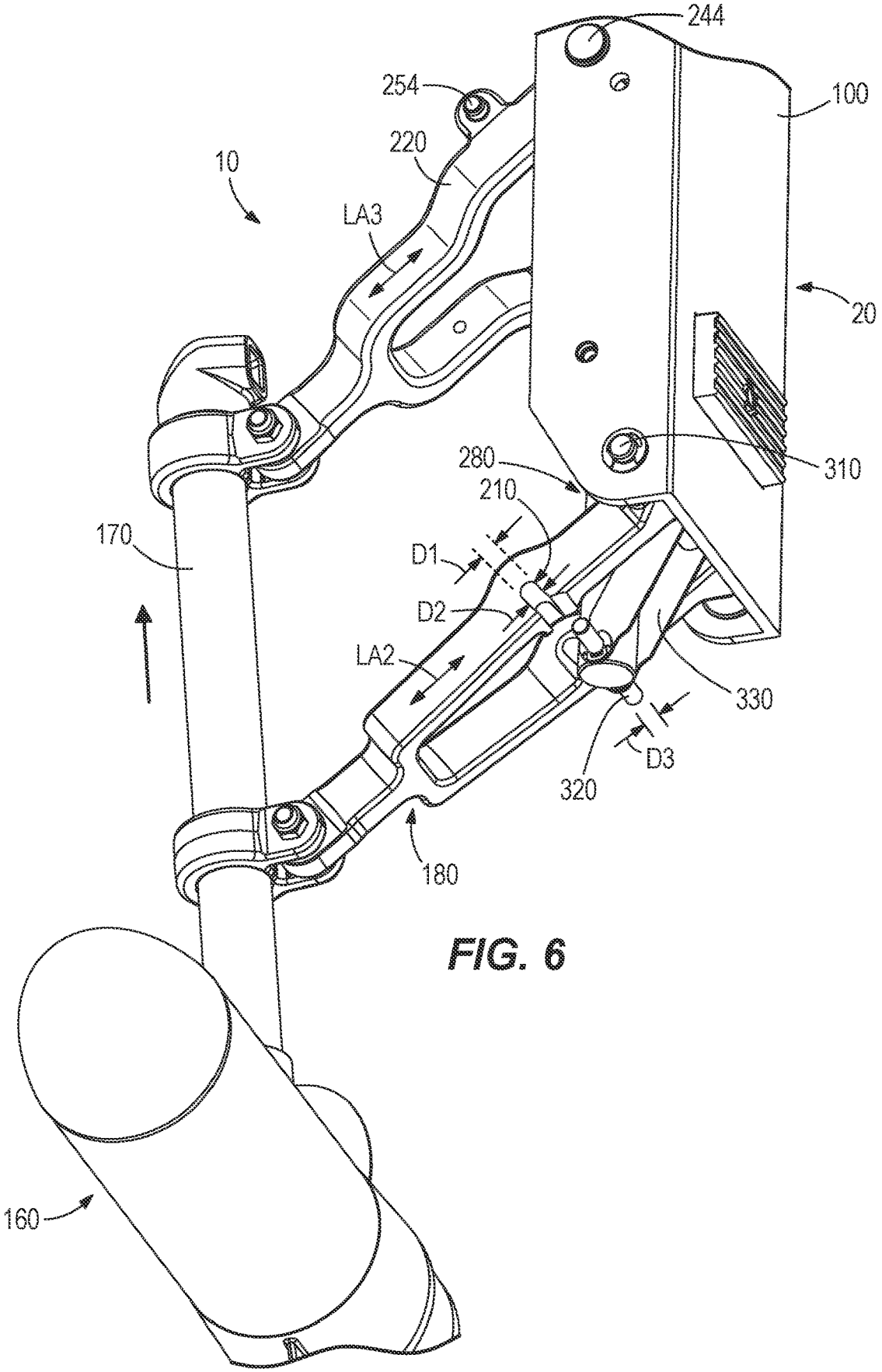
FIG. 6 depicts the embodiment of FIG. 5 with an actuator disengaged.

The press-fit arrangement is further shown in FIG. 6, whereby the shaft 320 has a diameter D3 that generally corresponds to a diameter D1 of the opening 210 nearest the upper edge 206 of the pivot arm 180, but the shaft 320 must first pass through a narrowed diameter D2 of the opening 210 when moving upwardly from the lower edge 208. This configuration provides that the actuator 280 prevents the shaft 170 from being moved manually when the shaft 320 is engaged within the opening 210 in this press-fit arrangement, but the shaft 320 can be disengaged from the opening 210 by applying a pre-determined force separating the shaft 320 from the pivot arm 180, as discussed further below.

A shown in FIG. 3, the propulsion device 10 further includes an engagement arm 330 that extends from a first end 332 to a second end 334 forming a length axis LA5 therebetween. In the embodiment shown, the engagement arm 330 includes opposing engagement members 336 coupled by a base 338. However, it should be recognize that configurations of engagement arms 330 having greater or fewer engagement members are also contemplated by the present disclosure, including having a single engagement arm. Openings 340 are provided near the second end 334 of the opposing engagement members 336, as well as openings 342 near the first end 332. The openings 340 near the second end 334 are configured to receive the axle 310 therethrough, whereby the axle 310 also extends through the openings 210 in the opposing fork segments 240 of the pivot arm 180 as discussed above. Retaining clips 319 are received within the inner grooves 318 of the axle 310 to maintain the axial position of the engagement arm 330 relative to the axle 310. The engagement arm 330 is approximately centered along the length of the axle 310 such that the opposing engagement arms 336 of the engagement arm 330 are sandwiched between the rod 300 and the actuator 280 and the opposing fork segments 200 of the pivot arm 180.

Similarly, the shaft 320 discussed above is received through the openings 342 in the first ends 332 of the opposing engagement members 336. The opposing engagement member 336 are again retained in axial position relative to the shaft 320 via engagement of retaining rings 326 within the grooves 324 recessed into the shaft 320. In this manner, the engagement arm 330 is pivotable at its second end 334 relative to the base 20, and also pivotally coupled to the rod 300 of the actuator 280 such that actuation of the actuator 280 causes pivoting of the engagement arm 330. This ensures that the shaft 320 follows an arc about the axle 310 to ensure alignment between the shaft 320 and the opening 210 in the opposing fork segments 200 of the pivot arm 180.

Figure 4:
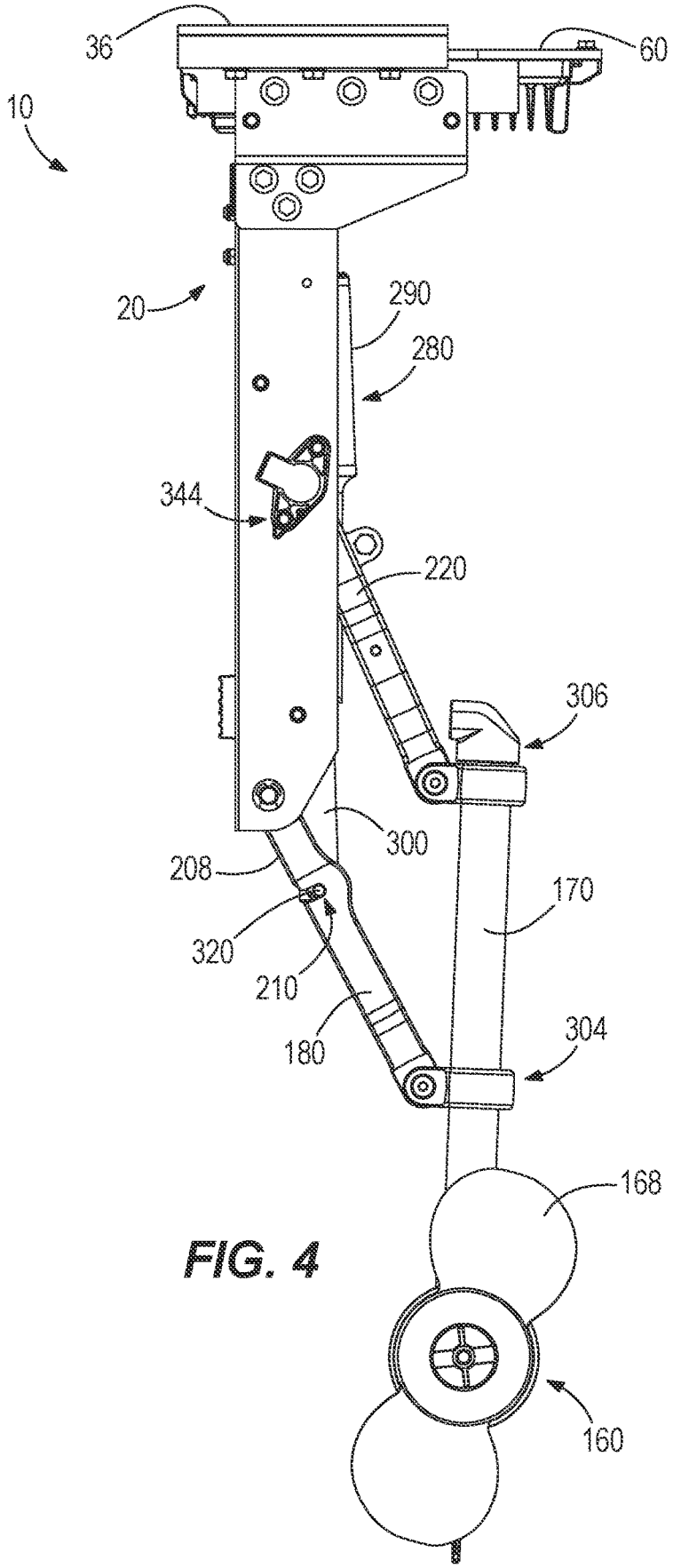
FIG. 4 is a left view of the embodiment of FIG. 1 shown in a fully deployed position.
Figure 5:
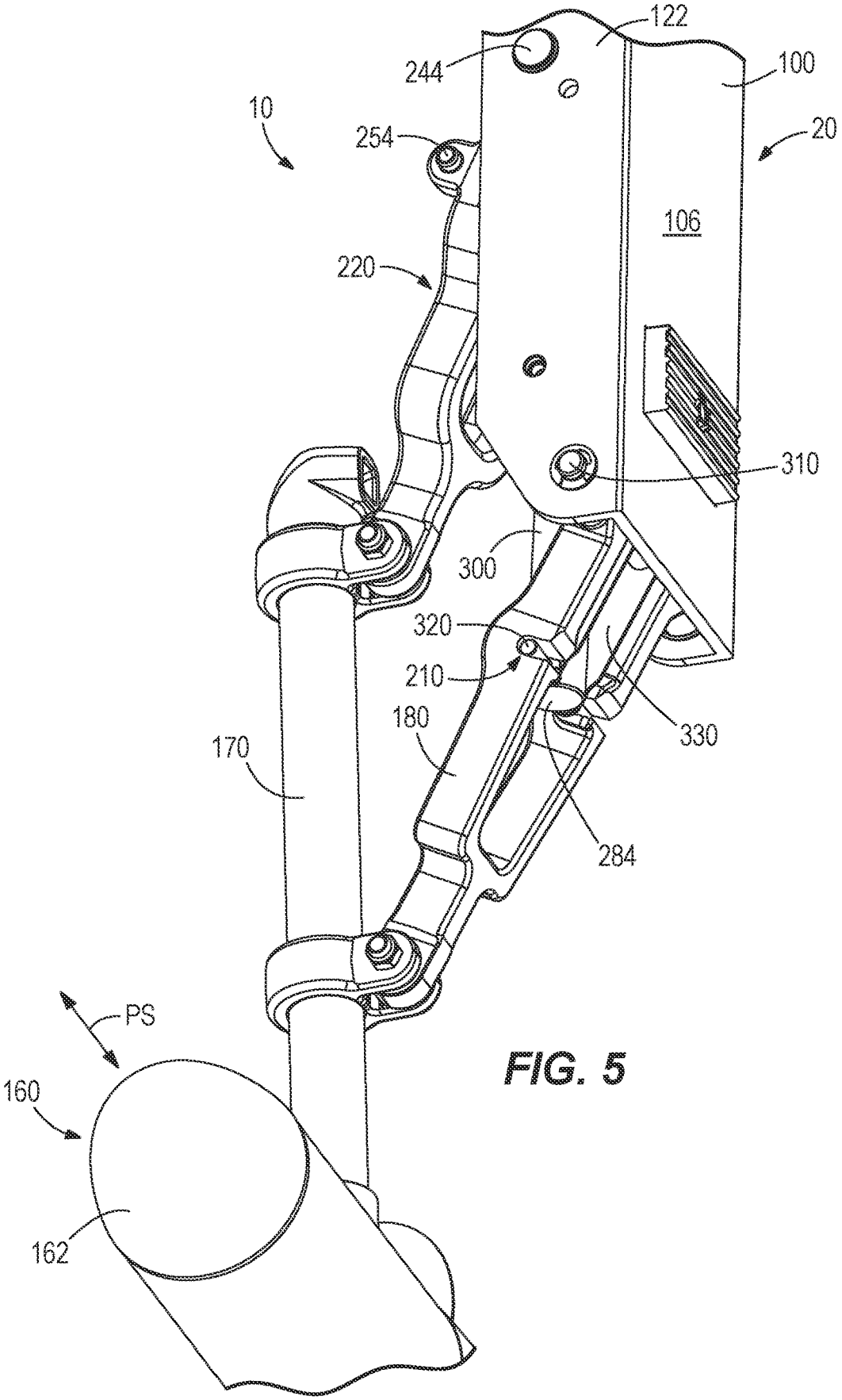
FIG. 5 is a right, front perspective view of the embodiment shown in FIG. 4.

FIGS. 4 and 5 shows the propulsion device 10 in a fully deployed position, whereby the actuator 280 has extended the rod 300 away from the housing 290, and whereby engagement of the shaft 320 between the rod 300 and the pivot arm 180 causes pivoting of the pivot arm 180 and, consequently, movement of the shaft 170. In the embodiment shown, the propulsor 160 is configured to propel the marine vessel 1 in the port-starboard direction PS.

In contrast, FIG. 6 depicts the propulsion device 10 after a force has been imparted on the propulsor 160 and/or the shaft 170 (directly or indirectly), for example as may occur during a collision with an underwater object. In particular, the force has exceeded the predetermined force (e.g., towards the stowed direction, or in other words moving the pivot arm 180 away from the rod 300 of the actuator 280), forcing the shaft 320 out of engagement within the opening 120. In certain embodiments, the predetermined force to disengage the shaft 320 from the opening 120 is selected such that the propulsor 160 remains down at approximately 6 mph of forward travel for the marine vessel 1. In other words, the predetermined force is sufficiently high to prevent unintentional disengagement of the shaft 320 under normal operator conditions. It should be recognized that the engagement arm 330 remains coupled to both the base 20 and the shaft 320. However, since the shaft 320 is no longer positioned within the opening 210 in the pivot arm 180, the actuator 280 is no longer coupled to the pivot arm 180.

In this manner, the presently disclosed propulsion device 10 provides that the actuator 280 automatically disengages with the shaft 170 in the event of a forward impact strike, thereby preventing harm to the actuator 280 or other components of the propulsion device 10.

Figure 7:
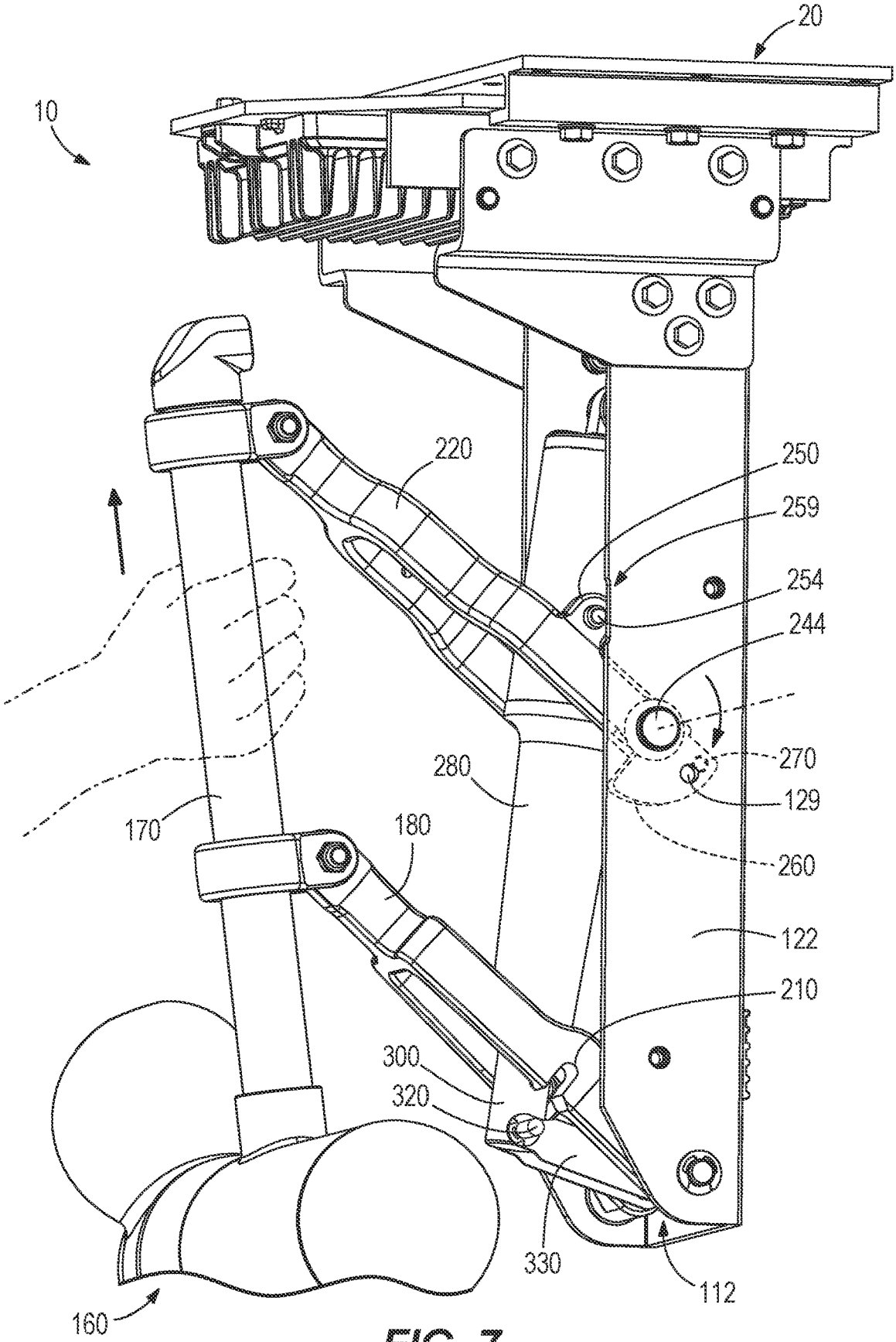
FIG. 7. depicts the embodiment of FIG. 6 with the pivot arm shown further rotated towards a locked position.

As shown in FIG. 7, the presently disclosed propulsion device 10 also provides for manual disengagement of the actuator 280. The present inventors have recognized that manual disengagement is advantageous when trailering the marine vessel 1 such that vibrations of the shaft 170 and propulsor 160 do not cause strain on the actuator 280. As discussed above, the present inventors have further identified a need to manually lock the propulsion device 10 in a locked position when the actuator 280 is disengaged such that the shaft 170 is not free to move about unconstrained.

With reference to FIGS. 3 and 7, the propulsion device 10 includes a detent 254 configured to resist and/or slow movement of the shaft 170 as it approaches the locked position of FIG. 7. In particular, the secondary arm 220 includes a detent extension 250, whereby the detent 254 is coupled to the detent extension 250 such that a tip 258 of the detent 254 extends to an opening 252 therein. Similarly, a recess 259 is formed within the rearward edge of the side extensions 122 of the base 20. The recess 259 guides the tip 258 of the detent 254 as contact is made between the tip 258 and the base 20. The detent 254 provides resistance in further rotation of the shaft 170 beyond initial contact by the tip 258, slowing and/or preventing accidental rotation into the locked position (for example by virtue of an impact strike, rather than deliberately locking the propulsion device 10).

With continued reference to FIGS. 3 and 7, the secondary arm 220 also includes a lock extension 260 provided near the second end 224 of the secondary arm 220. In the embodiment shown, the lock extension 260 includes a rounded edge 262, which ensures clearance between the lock extension and the front plate 112 of the base 20 while rotating the secondary arm 220 between the locked, deployed, and stowed positions. An opening 264 is provided within the lock extension 260, which is configured to receive a detent pin 270 therethrough. The detent pin 270 extends between a head and a tip 274 (FIG. 3) with a groove 276 recessed into the detent pin 270 therebetween. In particular, from the head 272 to the tip 274, the detent pin 270 is received through the opening 264 in the lock extension 260, then extending through a spring 275, a washer 278, and retaining ring 279 that engages with the groove 276 defined in the detent pin 270.

Figure 8:
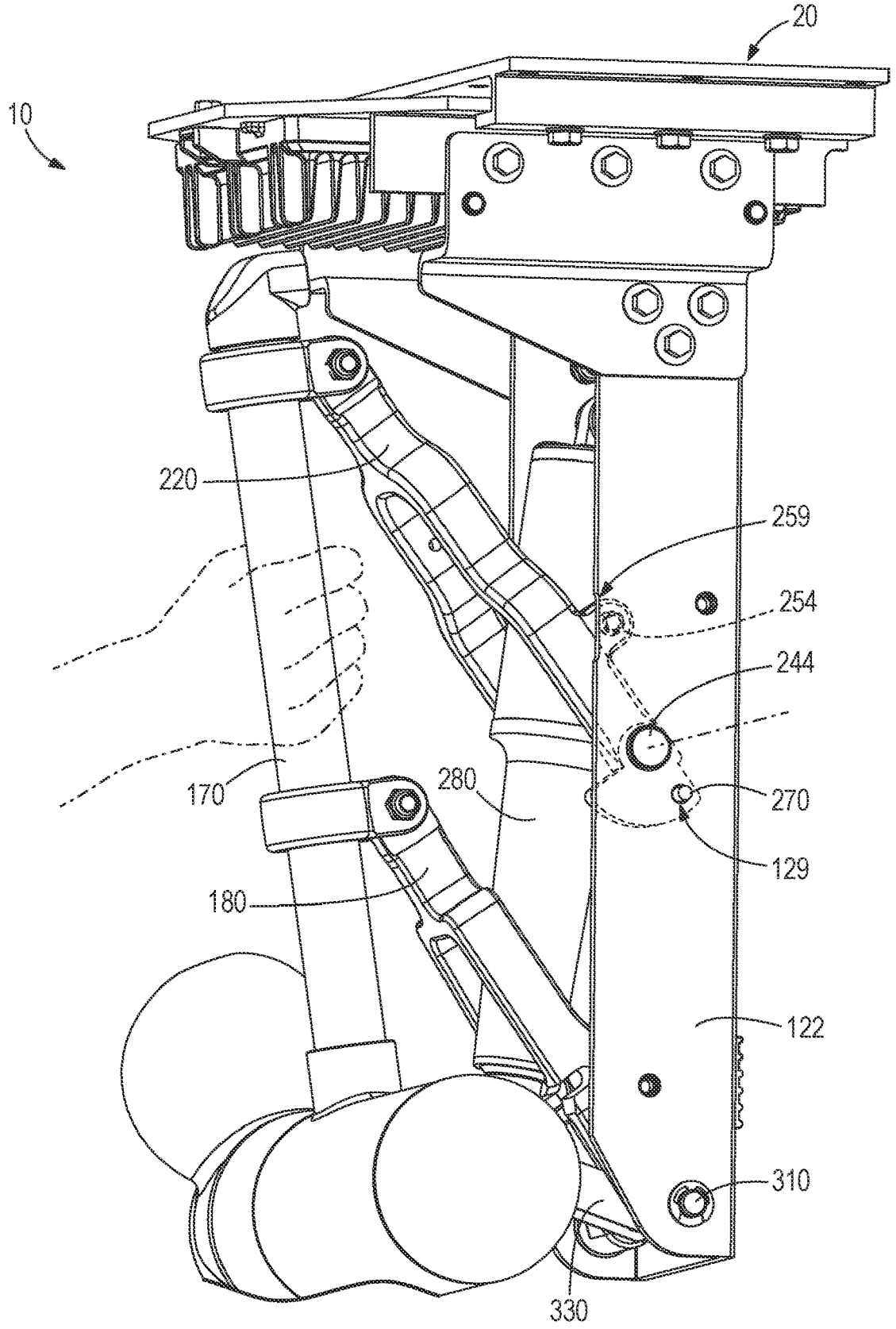
FIG. 8 depicts the embodiment of FIG. 7 in the locked position.

In this manner, the spring 275 biases the tip 274 outwardly (i.e., away from the secondary arm 220) towards the base 20. As shown in FIG. 7, as the shaft 170 is moved, the secondary arm 220 and lock extension 260 thereof rotate. Once the secondary arm 220 reaches the locked position (as shown in FIG. 8), the detent pin 270 is aligned with the lock opening 129 in the side extension 122 of the base 20. The detent pin 270 is then forced to extend through the lock opening 129 by the spring 275, pivotally locking the secondary arm 220 relative to the base 20 and thus rendering the shaft 170 immobile. The present inventors have recognized the present design is particularly advantageous in that in allows the operator to manually disengage the actuator 280 and lock the propulsion device 10 in the locked position with a single motion, and requiring only one hand. This feature is particularly beneficial is the actuator 280 malfunctions. It should be recognized that once the operator desires to unlock the propulsion device 10, the detent pin 270 may be forced inwardly, allowing the secondary arm 220 to once again pivot such that the detent pin 270 no longer aligns with the lock opening 129. It should be recognized that the present disclosure also contemplates the detent pin 270 preventing rotation of the secondary arm 220 in other manners. For example, the detent pin 270 may be oriented to extend inwardly from the side extension 122 to engage with the secondary arm 220 or lock extension 260 thereof (e.g., within an opening defined therein). In this example, the detent pin 270 may be provided at the end of a spring-loaded handle such that the detent pin 270 is released by pulling away from the side extension 122 rather than pressing inwardly as shown in FIG. 7.

Returning to FIGS. 2 and 3, one of the opposing fork segments 240 is rotatably coupled to the base 20 via a position sensor 344 rather than a pin 244 as previously discussed for the other one of the opposing fork segments 240. The position sensor 344 has a body 346 with a rotating shaft 350 extending therefrom. The body 346 is attached to the base 20 via fasteners 348, such as bolts, screws, welds, rivets, or other methods known in the arts. Threads 352 are provided at the end of the rotating shaft 350, whereby after the rotating shaft 350 is received through the opening 242 in the opposing fork segment 240, a nut 354 is engaged with the threads 352 to retain the secondary arm 220 on the base 20. Exemplary sensors useable as the position sensor 344 include trim sensors known in the art, for example the trim sensor of the Mercury SeaPro 150HP (Mercury part number 8M0168637). The position sensor 344 is configured to detect the position of the secondary arm 220 and thus to infer the position of the propulsor 160 based on the rotational position of the rotating shaft 170. The position of the secondary arm 220 can then be used to infer (e.g., via communication with the control system CS100 of FIG. 9) the position of the shaft 170 and propulsor 160, such as to inform the operator when the propulsor 160 is in the stowed position (FIG. 2), deployed position (FIG. 4), a lock position (FIG. 8) to be discussed further below, and any position therebetween.

Figure 9:
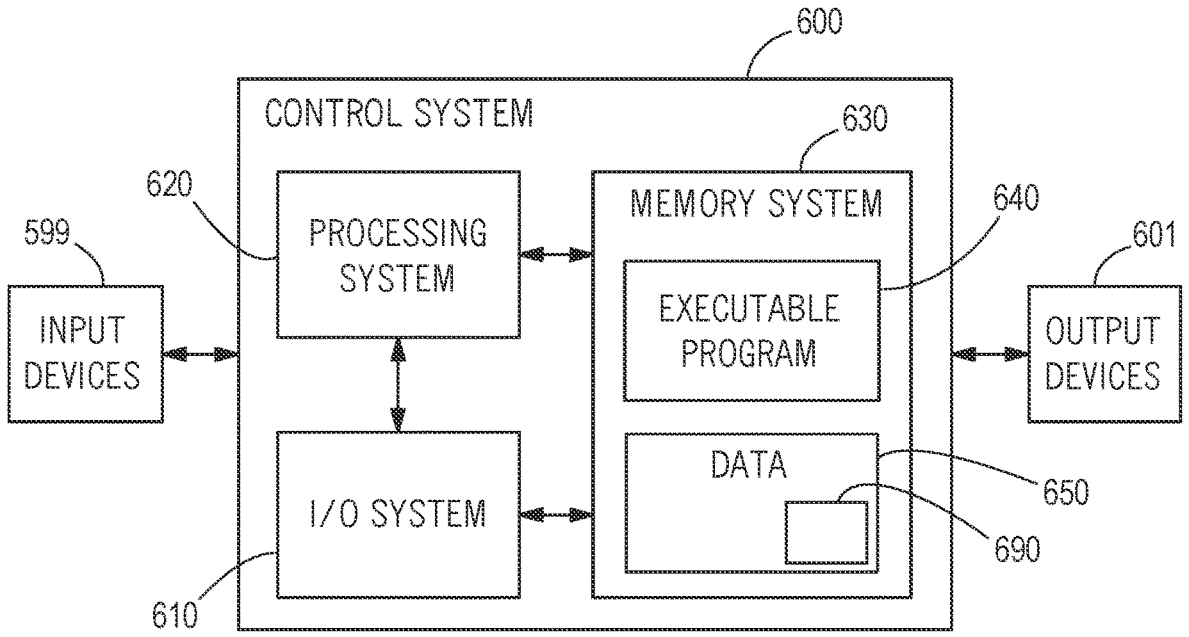
FIG. 9 depicts an exemplary control system for determining a position of the pivot arm according to the present disclosure.

FIG. 9 depicts an exemplary control system 600 for detecting the position of the shaft 170 via the position sensor 344 discussed above (e.g., within and between stowed, deployed, and locked positions), as discussed above. The control system 600 may provide feedback to the operator regarding detected position of the shaft 170, such as audible and/or visible feedback via a graphical user interface and/or other gauge at the helm of the marine vessel. The control system 600 communicates with the position sensor 344 via a communication link CL, which can be any wired or wireless link. In one example, the communication link CL is a controller area network (CAN) bus; however, other types of links could be used.

The control system 600 of FIG. 9 may be a computing system that includes a processing system 610, memory system 620, and input/output (I/O) system 630 for communicating with other devices, such as input devices 599 (e.g., the position sensor 344) and output devices 601 (e.g., a gauge at the helm). The processing system 610 loads and executes an executable program 622 from the memory system 620, accesses data 624 stored within the memory system 620, and directs the propulsion device 10 to operate as described in further detail below.

The processing system 610 may be implemented as a single microprocessor or other circuitry, or be distributed across multiple processing devices or sub-systems that cooperate to execute the executable program 622 from the memory system 620. Non-limiting examples of the processing system include general purpose central processing units, application specific processors, and logic devices. The memory system 620 may comprise any storage media readable by the processing system 610 and capable of storing the executable program 622 and/or data 624.

In this manner, the position data from the position sensor 344 may not only be used to provide feedback to the operator, but also be used to control the propulsion device 10. For example, the control system 600 may prevent the propulsor 160 from rotating the propeller 128 when the shaft 170 is in the stowed or locked positions. Likewise, the control system 600 may use the data from the position sensor 344 to control the actuator of the actuator 280 to avoid over-extending or over-retracting the rod 300 from the housing 290.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A device for supporting a propulsor on a marine vessel, the device comprising:

a base configured to be coupled to the marine vessel;

a pivot arm that couples the propulsor to the base;

an actuator that moves the propulsor via moving the pivot arm relative to the base into and between a stowed position and a deployed position; and an engagement arm coupled to the actuator and moveable relative to the base to control the movement of the actuator, wherein the pivot arm is pivotally coupled to the base other than through the engagement arm and the engagement arm is coupled to the actuator other than through the pivot arm.

2. The device according to claim 1, wherein the engagement arm is sandwiched between the actuator and the pivot arm.

3. The device according to claim 1, wherein the pivot arm is pivotally coupled to the base via an axle, and the engagement arm is pivotally coupled to the base via the axle.

4. The device according to claim 1, wherein the base comprises a front plate having side extensions extending rearwardly therefrom, and wherein the pivot arm and the engagement arm are each pivotally coupled to the side extensions of the base.

5. The device according to claim 1, wherein the actuator is a linear actuator positioned such that extending the linear actuator moves the propulsor towards the deployed position and retracting the linear actuator moves the propulsor towards the stowed position.

6. The device according to claim 1, wherein the actuator is pivotally coupled to the base, and wherein the engagement arm is pivotally coupled to the base vertically lower than wherein the actuator is pivotally coupled to the base.

7. The device according to claim 1, wherein the actuator is pivotally coupled to the base, and wherein the pivot arm is pivotally coupled to the base vertically lower than wherein the actuator is pivotally coupled to the base.

8. The device according to claim 1, wherein the engagement arm and the pivot arm each have a fixed length, and wherein the actuator is operable to have an adjustable length, wherein adjusting the length of the actuator moves the propulsor via the pivot arm.

9. The device according to claim 1, wherein a shaft couples the propulsor to the pivot arm, and wherein the actuator is coupled to the pivot arm closer along the pivot arm to the base than to the shaft.

10. The device according to claim 1, wherein the pivot arm is a first pivot arm, further comprising a second pivot arm that couples the propulsor to the base.

11. The device according to claim 10, wherein the first pivot arm and the second pivot arm are each pivotally coupled to the base.

12. The device according to claim 11, wherein the first pivot arm and the second pivot arm are positioned so as to remain parallel to each other when moving the propulsor between the stowed position and the deployed position.

13. A device for supporting a propulsor on a marine vessel, the device comprising:

a base configured to be coupled to the marine vessel;

a pivot arm that couples the propulsor to the base; and an actuator operable to move the propulsor from a deployed position to a stowed position, wherein the propulsor is manually movable from the deployed position to the stowed position without operating the actuator, wherein the actuator is selectively coupleable to the pivot arm, and wherein moving the propulsor from the deployed position to the stowed position without operating the actuator decouples the actuator from the pivot arm.

14. The device according to claim 13, wherein the actuator moves the propulsor via the pivot arm.

15. A device for supporting a propulsor on a marine vessel, the device comprising:

a base configured to be coupled to the marine vessel;

a pivot arm that pivotally couples the propulsor to the base, the pivot arm being a fork having a neck and opposing fork segments; and an actuator operable to move the propulsor into and between a stowed position and a deployed position, wherein the actuator is coupled to the pivot arm so as to not prevent the pivot arm from being manually pivoted to move the propulsor from the deployed position to the stowed position without operating the actuator.

16. A device for supporting a propulsor on a marine vessel, the device comprising:

a base configured to be coupled to the marine vessel;

a pivot arm that couples the propulsor to the base, the pivot arm being a fork having a neck and opposing fork segments; and an actuator that moves the propulsor into and between a stowed position and a deployed position, wherein the actuator is positioned between the opposing fork segments.

17. A device for supporting a propulsor on a marine vessel, the device comprising:

a base configured to be coupled to the marine vessel;

a pivot arm that couples the propulsor to the base, the pivot arm being a fork having a neck and opposing fork segments; and an actuator that moves the propulsor into and between a stowed position and a deployed position, wherein the actuator is selectively coupleable to the opposing fork segments such that moving the actuator moves the pivot arm.

18. A device for supporting a propulsor on a marine vessel, the device comprising:

a base configured to be coupled to the marine vessel;

a pivot arm that couples the propulsor to the base;

an actuator that moves the propulsor into and between a stowed position and a deployed position; and a lock engageable to prevent the propulsor from moving out of a locked position, wherein the propulsor moves farther when moving from the deployed position to the locked position than when moving from the deployed position to the stowed position.

19. The device according to claim 18, wherein the lock comprises a detent engaged by moving the propulsor from the stowed position to the locked position.

* * * * *